US009421558B2

(12) United States Patent
Zhou et al.

(10) Patent No.: US 9,421,558 B2
(45) Date of Patent: Aug. 23, 2016

(54) MASSAGE WATER OUTLET MECHANISM AND A ROTOR COMPONENT THEREOF

(75) Inventors: Huasong Zhou, Xiamen (CN); Wenxing Chen, Xiamen (CN); Denghui Bai, Xiamen (CN); Qingshuang Li, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 349 days.

(21) Appl. No.: 14/000,273

(22) PCT Filed: Feb. 14, 2012

(86) PCT No.: PCT/CN2012/071097

§ 371 (c)(1), (2), (4) Date: Aug. 19, 2013

(87) PCT Pub. No.: WO2012/109973

PCT Pub. Date: Aug. 23, 2012

(65) Prior Publication Data

US 2013/0320111 A1 Dec. 5, 2013

(30) Foreign Application Priority Data

Feb. 17, 2011 (CN) ..... 2011 1 0040202
Feb. 17, 2011 (CN) ..... 2011 2 0040706 U

(51) Int. Cl.
*B05B 3/00* (2006.01)
*B05B 1/18* (2006.01)
(Continued)

(52) U.S. Cl.
CPC ..... *B05B 1/185* (2013.01); *A61H 9/0007* (2013.01); *A61H 9/0028* (2013.01); *B05B 1/083* (2013.01); *B05B 1/1663* (2013.01); *B05B 1/18* (2013.01); *B05B 3/04* (2013.01)

(58) Field of Classification Search
CPC ..... B05B 1/18; B05B 1/1663; B05B 1/083; B05B 1/185; B05B 3/04; A61H 9/0028; A61H 9/0007
USPC ..... 239/381–383, 394, 395, 562, 563
See application file for complete search history.

(56) References Cited

U.S. PATENT DOCUMENTS 137,095 A * 3/1873 Ransom ..... B05B 1/18 239/443
2,327,306 A * 8/1943 Holden ..... B05B 1/1636 210/449

(Continued)

FOREIGN PATENT DOCUMENTS

CN 2552608 Y 5/2003
CN 2636855 Y 9/2004

(Continued)

*Primary Examiner* — Jason Boeckmann
(74) *Attorney, Agent, or Firm* — Rabin & Berdo, P.C.

(57) ABSTRACT

A massage water outlet mechanism has a rotor component and an annular outlet cavity, which is disposed with a bottom wall with several spaced outlet holes. The outlet cavity has a rotor component, which can slide along the outlet cavity. The rotor component includes several rotors which close the outlet holes in cycles. The rotor includes a close plate and a connection plate, the rear portion of the bottom surface of the connection plate is fixed to the front portion of the top surface of the close plate, the top surface of the close plate is disposed with a pivot shaft, the connection plate is disposed with a pivot hole; in each two adjacent rotors, the connection plate of the latter rotor is contacted on the close plate of the previous rotor, and the pivot hole of the latter rotor is sleeved on the pivot shaft of the previous rotor.

10 Claims, 7 Drawing Sheets

(51) Int. Cl.

| | |
|---|---|
| ***A61H 9/00*** | (2006.01) |
| ***B05B 1/08*** | (2006.01) |
| ***B05B 1/16*** | (2006.01) |
| ***B05B 3/04*** | (2006.01) |

(56) References Cited

U.S. PATENT DOCUMENTS

| | | | | |
|---|---|---|---|---|
| 4,094,468 | A | 6/1978 | Volle | |
| 4,219,160 | A * | 8/1980 | Allred, Jr. | B05B 1/18 239/447 |
| 6,238,178 | B1 * | 5/2001 | Stearne | F01D 15/06 137/99 |
| 8,403,240 | B2 * | 3/2013 | Chen | B05B 1/14 239/240 |
| 8,794,543 | B2 * | 8/2014 | Leber | B05B 3/04 239/381 |
| 2011/0192915 | A1 * | 8/2011 | Li | B05B 1/18 239/394 |

FOREIGN PATENT DOCUMENTS

| | | | |
|---|---|---|---|
| CN | 1634666 | A | 7/2005 |
| CN | 201968980 | U | 9/2011 |
| JP | 1104361 | | 4/1989 |

* cited by examiner

MASSAGE WATER OUTLET MECHANISM AND A ROTOR COMPONENT THEREOF

FIELD OF THE INVENTION

The present invention relates to a massage water outlet mechanism and a rotor component thereof.

BACKGROUND OF THE INVENTION

The existing massage water outlet mechanism comprising an annular outlet cavity, which is disposed with a bottom wall, the bottom wall is disposed with several spaced outlet holes, the outlet cavity is disposed with a rotor, which can slide along the outlet cavity, the rotor close the outlet holes in cycles so as to discharge massage water. The existing massage water outlet mechanism is just disposed with a single rotor, it has disadvantages as below: 1. it has to design the existing outlet cavity to be circular annular shape, other annular shapes such as a figure of 8, elliptical shape or square shape are unavailable; 2. the massage water frequency of the existing outlet cavity is controlled by the shape and the size of the rotor, however, the shape and size of the rotor are usually changeless, so that the massage water frequency of the existing technology is difficult to adjusted; 3. different diameter of the circular cavity of the message water outlet mechanism has to be applied with different rotor.

SUMMARY OF THE INVENTION

The present invention is provided with a massage water outlet mechanism and a rotor component thereof, which overcome the disadvantages of the existing technology.

One of the technical proposals of the present invention to solve the technical problems is as below:

A massage water outlet mechanism, comprising an annular outlet cavity, which is disposed with a bottom wall, the bottom wall is disposed with several spaced outlet holes, the outlet cavity is disposed with a rotor component, which can slide along the outlet cavity, the rotor component includes several rotors, the rotors close the outlet holes in cycles to discharge massage water, the rotor includes a close plate and a connection plate, the rear portion of the bottom surface of the connection plate is fixed to the front portion of the top surface of the close plate, the top surface of the close plate is disposed with a pivot shaft, the connection plate is disposed with a pivot hole; in each two adjacent rotors, the connection plate of the latter rotor is contacted on the close plate of the previous rotor, and the pivot hole of the latter rotor is sleeved on the pivot shaft of the previous rotor, making the two adjacent rotors rotated relatively.

In another preferred embodiment, the front end face of the close plate of the rotor is arc shaped with the centre of a circle in the front, the back end face of the close plate is arc shaped with the centre of a circle in the front, in each two adjacent rotors, the front end face of the latter rotor's close plate is coupled to the back end face of the previous rotor's close plate, making two adjacent rotors rotated relatively.

In another preferred embodiment, in two adjacent rotors, a clearance is disposed between the front end face of the close plate of the latter rotor and the back end face of the close plate of the previous rotor.

In another preferred embodiment, the diameter of the arc of the front end face of the close plate of the rotor is equal to that of the back end face.

In another preferred embodiment, the rear end of the connection plate of the rotor is arc shaped with the centre of a circle in the back, the front end of the connection plate is arc shaped with the center of a circle in the back.

In another preferred embodiment, a strengthening base is shaped and extended upwards from the rear portion of the connection plate of the rotor, the strengthening base is an arc shaped plate.

The second technical proposal of the present invention to solve the technical problems is as below:

A rotor component of a massage water outlet mechanism, comprising several rotors, the rotors are close the outlet holes in cycles so as to discharge massage water, the rotor includes a close plate and a connection plate, the rear portion of the bottom surface of the connection plate is fixed to the front portion of the top surface of the close plate, the top surface of the close plate is disposed with a pivot shaft, the connection plate is disposed with a pivot hole; in each two adjacent rotors, the connection plate of the latter rotor is contacted on the close plate of the previous rotor, and the pivot hole of the latter rotor is sleeved on the pivot shaft of the previous rotor, making the two adjacent rotors rotated relatively.

In another preferred embodiment, the front end face of the close plate of the rotor is arc shaped with the centre of a circle in the front, the back end face of the close plate is arc shaped with the centre of a circle in the front, in each two adjacent rotors, the front end face of the latter rotor's close plate is coupled to the back end face of the previous rotor's close plate, making two adjacent rotors rotated relatively.

In another preferred embodiment, in two adjacent rotors, a clearance is disposed between the front end face of the close plate of the latter rotor and the back end face of the close plate of the previous rotor.

In another preferred embodiment, the rear end of the connection plate of the rotor is arc shaped with the centre of a circle in the back, the front end of the connection plate is arc shaped with the center of a circle in the back; a strengthening base is shaped and extended upwards from the rear portion of the connection plate of the rotor, the strengthening base is an arc shaped plate.

Compared to the existing technology, the present invention has advantages as below:

1. Two adjacent rotors can rotate relatively, so that the rotor component can not only apply in circular or annular cavity but also apply in circular or annular cavity with different diameter or other annular cavity, such as a figure of 8, elliptical shape, square shape or other irregular shape, it is strong in generality, the rotating is quick and natural, the structure is reliable and stable, it can also change the massage water frequency by changing the number of the rotors;

2. The front end face of the close plate of the rotor is arc shaped with the centre of a circle in the front, the back end face of the close plate is arc shaped with the centre of a circle in the front, the front end face is coupled to the back end face, making two adjacent rotors rotated relatively, it makes sure of the connection of the two adjacent rotors, the structure is reliable and stable;

3. The rear end of the connection plate of the rotor is arc shaped with the centre of a circle in the back, the front end of the connection plate is arc shaped with the center of a circle in the back, making two adjacent rotors rotated relatively, it makes sure of the connection of the two adjacent rotors, the structure is reliable and stable;

4. A strengthening base is shaped and extended upwards from the rear portion of the connection plate of the rotor, enhancing the impact of the water to the rotor component.

BRIEF DESCRIPTION OF THE DRAWINGS

The present invention will be further described with the drawings and the embodiments.

DETAILED DESCRIPTION OF THE EMBODIMENTS

The First Embodiment

Figure 1:
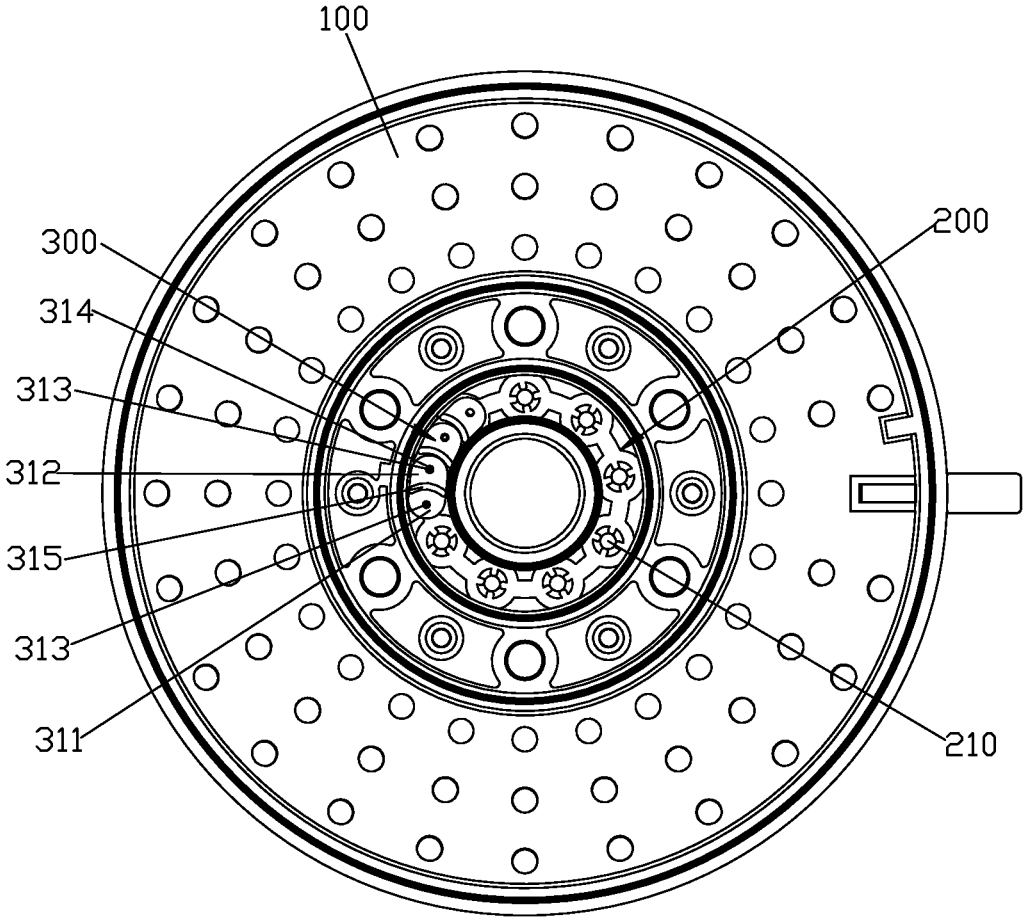
FIG. 1 illustrates the main structure of the massage water outlet mechanism of the first embodiment.
Figure 2:
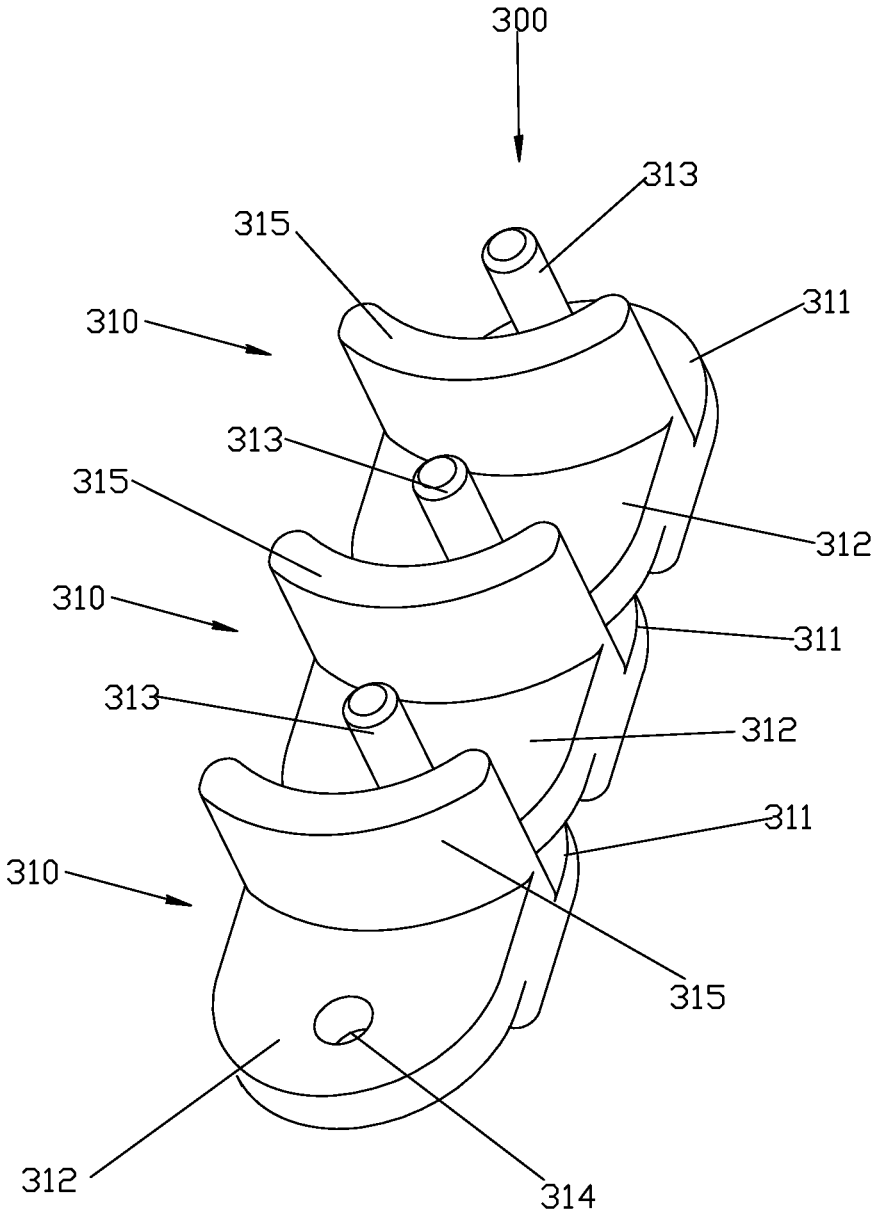
FIG. 2 illustrates the structure of the rotor component of the massage water outlet mechanism of the first embodiment.
Figure 3:
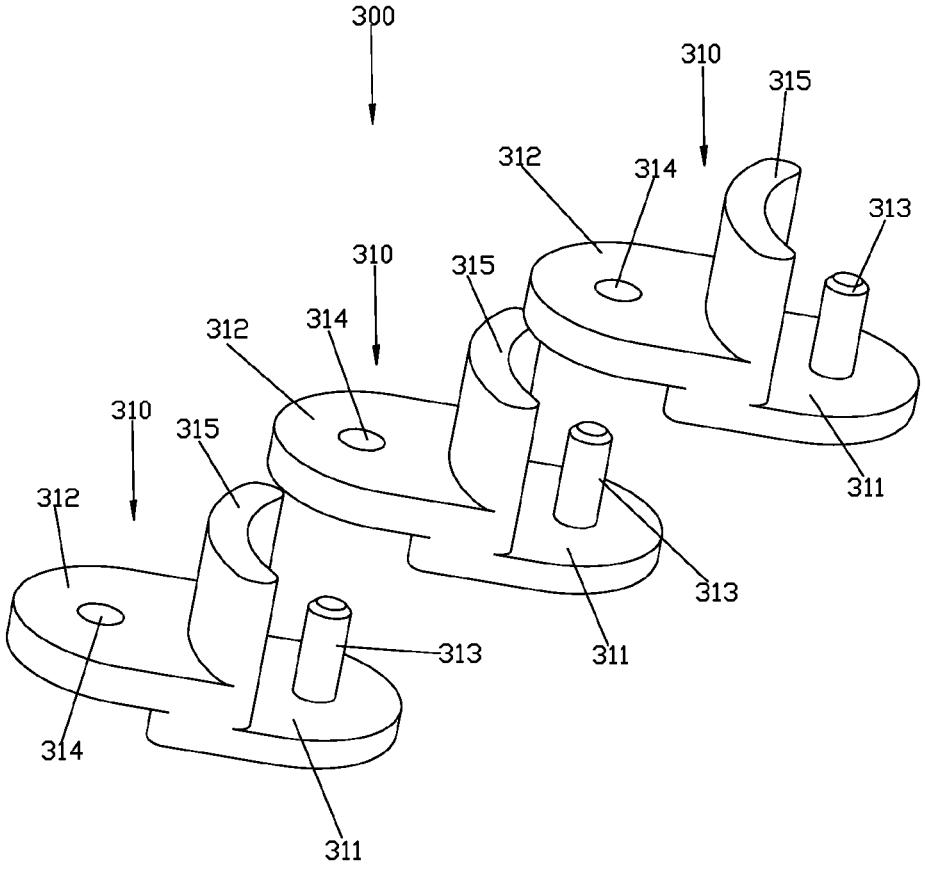
FIG. 3 illustrates the breakdown structure of the rotor component of the massage water outlet mechanism of the first embodiment.
Figure 4:
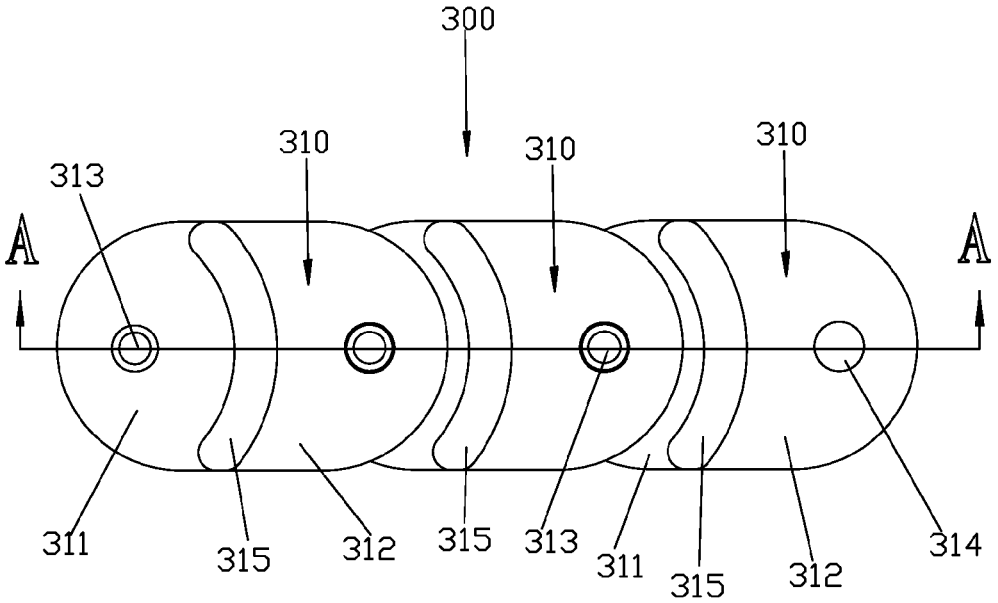
FIG. 4 illustrates the top view of the rotor component of the massage water outlet mechanism of the first embodiment.
Figure 5:
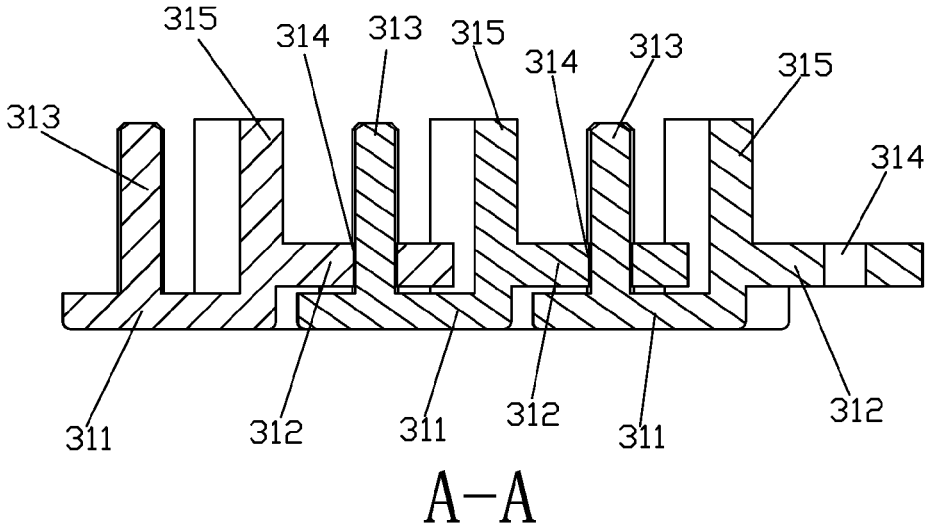
FIG. 5 illustrates the sectional view of the A-A of FIG. 4.

Please refer to FIG. 1 to FIG. 5, a massage water outlet mechanism of the present invention comprising a cover 100 and a water close cover, the reverse side of the cover 100 is disposed with four circular annular walls, the water close cover is fixed to the reverse side of the cover 100, making the two annular walls in the intermost formed a circular outlet cavity 200. the part of the outlet cavity 200 corresponding to the cover 100 is a bottom wall, the bottom wall is disposed with several outlet holes 210 spaced evenly, a rotor component 300 is disposed inside the outlet cavity 200, the rotor component 300 can slide along the outlet cavity 200 under the work of the water flowing. The rotor component 300 includes three rotors 310, which can close the outlet hole 210 in cycles so as to discharge massage water.

The rotor 310 includes a close plate 311 and a connection plate 312, the rear portion of the bottom surface of the connection plate 312 is fixed to the front portion of the top surface of the close plate 311, the centre of the top surface of the close plate 311 is disposed with a pivot shaft 313, the centre of the connection plate 312 is disposed with a pivot hole 314 throughout up and down. In each two adjacent rotors 310, the connection plate 312 of the latter rotor 310 is contacted on the close plate 311 of the previous rotor 310, and the pivot hole 314 of the rear rotor is sleeved on the pivot shaft 313 of the previous rotor 310, making the two adjacent rotors 310 rotated relatively.

In this embodiment, the front end face of the close plate 311 of the rotor 310 is arc shaped with the centre of a circle in the front, the back end face of the close plate 311 is arc shaped with the centre of a circle in the front, and the diameter of arc of the front end of the close plate 311 of the rotor is equal to that of the back end face. Besides, a clearance is disposed between the front end face of the close plate 311 of the later rotor 310 and the back end face of the close plate 311 of the previous rotor; the front end face of the connection plate 312 of the rotor 310 is arc shaped with the centre of a circle in the back, the back end face of the connection plate 312 is arc shaped with the centre of a circle in the back, and the diameters of the arc of the front end face and the back end face of the connection plate 312 of the rotor 310 are equal to each other and equal to the diameter of the close plate 311, a clearance of the front end face of the connection plate 312 of the latter rotor 310 and the back end face of the connection plate 312 of the previous rotor 310, making the two adjacent rotors 310 rotated relatively. In this embodiment, the centre of a circle of the arc is disposed in the vertical surface of the central line, the central angle can be 180 degrees.

In this embodiment, a strengthening base 315 is shaped and extended upwards from the rear portion of the connection plate 312 of the rotor 310, the strengthening base 315 is an arc shaped plate.

The Second Embodiment

Figure 6:
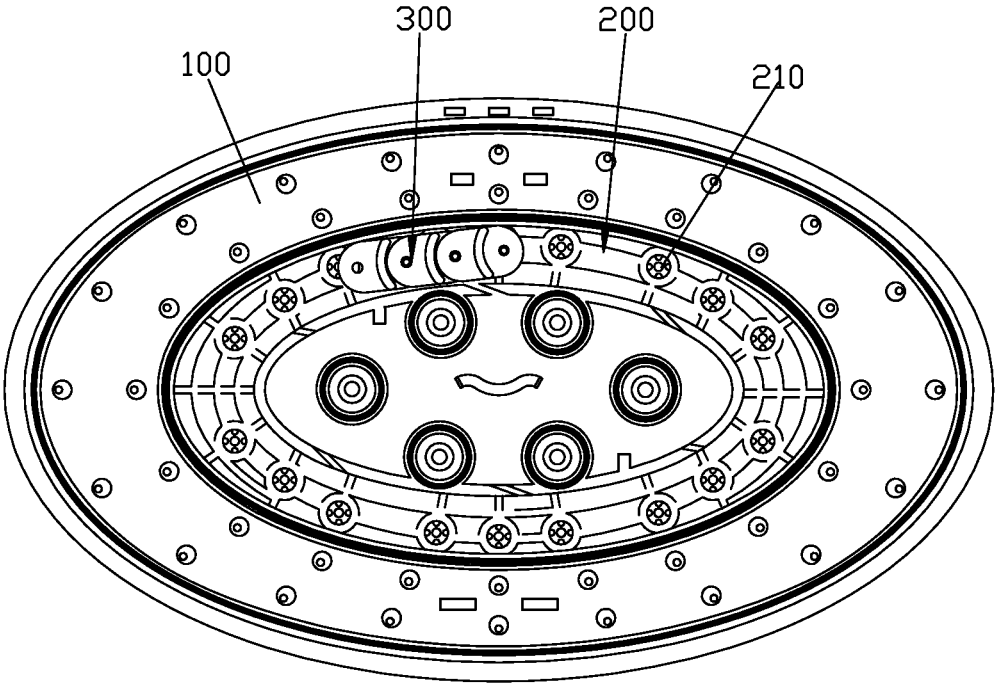
FIG. 6 illustrates the main structure of the massage water outlet mechanism of the second embodiment.

The difference of the second embodiment from the first embodiment is as below: refer to FIG. 6, the massage water outlet mechanism comprising a cover 100 and a water close cover, the reverse side of the cover 100 is disposed with three elliptical annular walls, the water cover plate is fixed to the reverse side of the cover 100, making the two annular walls in the intermost formed to be an elliptical outlet cavity 200.

The Third Embodiment

Figure 7:
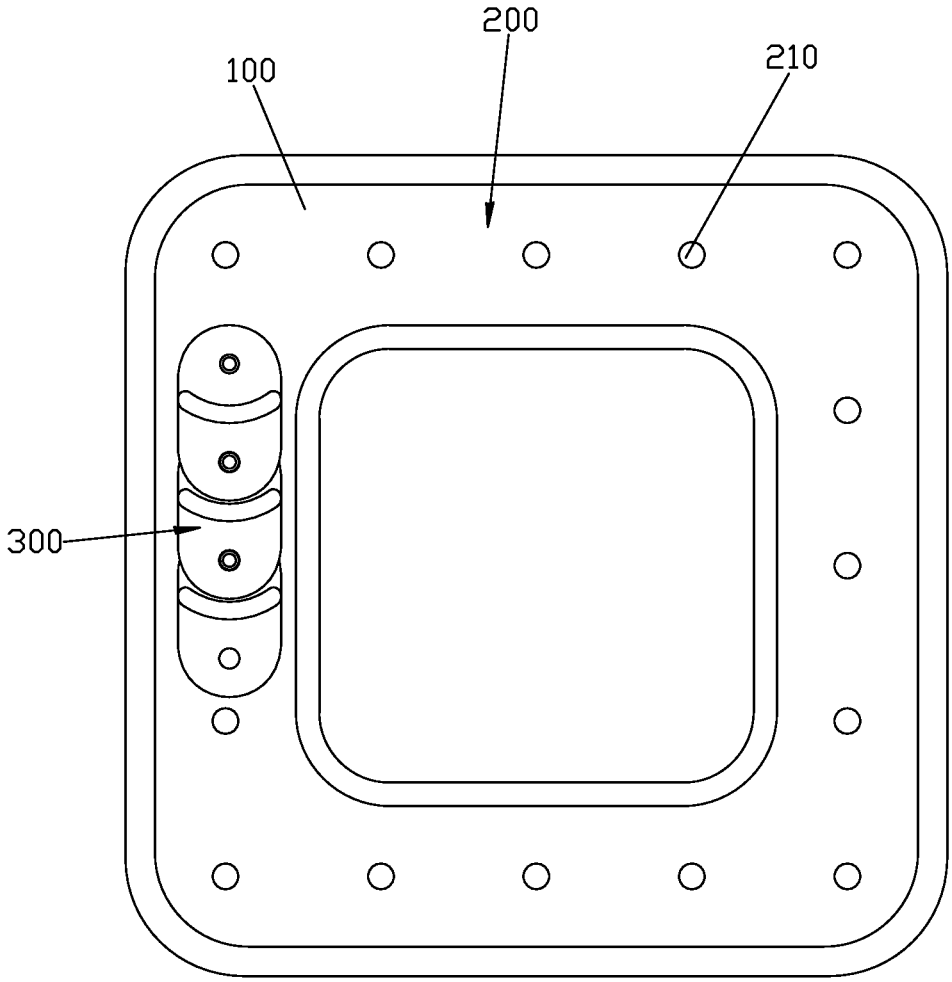
FIG. 7 illustrates the main structure of the massage water outlet mechanism of the third embodiment.

The difference of the third embodiment from the first embodiment is as below: refer to FIG. 7, the massage water outlet mechanism comprising a cover 100 and a water close cover, the reverse side of the cover 100 is disposed with two square annular walls, the water cover plate is fixed to the reverse side of the cover 100, making the two annular walls formed to be a square outlet cavity 200. The corners of the outlet cavity 200 are smoothed.

The Fourth Embodiment

Figure 8:
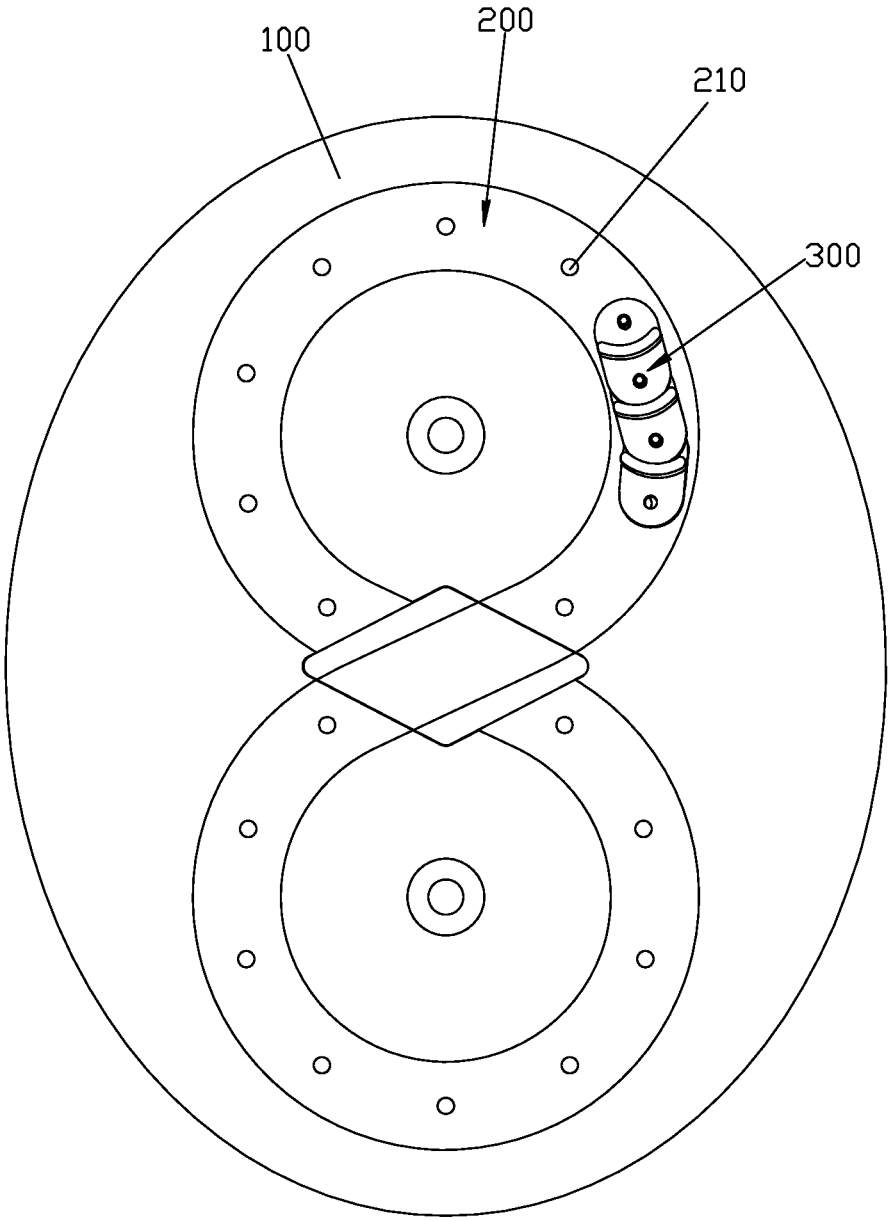
FIG. 8 illustrates the main structure of the massage water outlet mechanism of the fourth embodiment.

The difference of the fourth embodiment from the first embodiment is as below: refer to FIG. 8, the massage water outlet mechanism comprising a cover 100 and a water close cover, the reverse side of the cover 100 is disposed with a gourd shaped circular wall and two circular annular walls, the water cover plate is fixed to the reverse side of the cover 100, making the gourd shaped circular wall and the two circular annular walls formed to be a figure of 8 shaped outlet cavity 200.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A rotor component of a massage water outlet mechanism, comprising several rotors, the rotors close outlet holes in cycles so as to discharge massage water by action of work performed by flowing water, wherein:

each rotor includes a close plate and a connection plate, the rear portion of the bottom surface of the connection plate is fixed to the front portion of the top surface of the close plate, the top surface of the close plate is disposed with a pivot shaft, the connection plate is disposed with a pivot hole;

in each two adjacent rotors, the connection plate of the latter rotor is placed on the close plate of the previous rotor, and the pivot hole of the latter rotor is sleeved on the pivot shaft of the previous rotor, making the two adjacent rotors rotated relatively, wherein the rear end of the connection plate of the rotor is arc shaped with the centre of a circle in the back, the front end of the connection plate is arc shaped with the center of a circle in the back;

a strengthening base is shaped and extended upwards from the rear portion of the connection plate of the rotor, the strengthening base is an arc shaped plate.

2. A rotor component of a massage water outlet mechanism according to claim 1, wherein the front end face of the close plate of the rotor is arc shaped with the centre of a circle in the front, the back end face of the close plate is arc shaped with the centre of a circle in the front, in each two adjacent rotors, the front end face of the latter rotor's close plate is coupled to the back end face of the previous rotor's close plate, making two adjacent rotors rotated relatively.

3. A rotor component of a massage water outlet mechanism according to claim 2, wherein in two adjacent rotors, a clearance is disposed between the front end face of the close plate of the latter rotor and the back end face of the close plate of the previous rotor.

4. A rotor component of a massage water outlet mechanism according to claim 1, wherein the connection plate, the strengthening base and the close plate of the rotor are formed in one piece, the connection plate is parallel to the close plate.

5. A rotor component of a massage water outlet mechanism according to claim 2, wherein the connection plate, the strengthening base and the close plate of the rotor are formed in one piece, the connection plate is parallel to the close plate.

6. A rotor component of a massage water outlet mechanism according to claim 3, wherein the connection plate, the strengthening base and the close plate of the rotor are formed in one piece, the connection plate is parallel to the close plate.

7. A massage water outlet mechanism, comprising an annular outlet cavity, which is disposed with a bottom wall, the bottom wall is disposed with several spaced outlet holes, the outlet cavity is disposed with a rotor component, which can slide along the outlet cavity, the rotor component includes several rotors, the rotors close the outlet holes in cycles so as to discharge massage water, wherein:

each rotor includes a close plate and a connection plate, the rear portion of the bottom surface of the connection plate is fixed to the front portion of the top surface of the close plate, the top surface of the close plate is disposed with a pivot shaft, the connection plate is disposed with a pivot hole;

in each two adjacent rotors, the connection plate of the latter rotor is placed on the close plate of the previous rotor, and the pivot hole of the latter rotor is sleeved on the pivot shaft of the previous rotor, making the two adjacent rotors rotated relatively, the rear end of the connection plate of the rotor is arc shaped with the centre of a circle in the back, the front end of the connection plate is arc shaped with the center of a circle in the back, a strengthening base is shaped and extended upwards from the rear portion of the connection plate of the rotor, the strengthening base is an arc shaped plate.

8. A massage water outlet mechanism according to claim 7, wherein the front end face of the close plate of the rotor is arc shaped with the centre of a circle in the front, the back end face of the close plate is arc shaped with the centre of a circle in the front, in each two adjacent rotors, the front end face of the latter rotor's close plate is coupled to the back end face of the previous rotor's close plate, making two adjacent rotors rotated relatively.

9. A massage water outlet mechanism according to claim 8, wherein in two adjacent rotors, a clearance is disposed between the front end face of the close plate of the latter rotor and the back end face of the close plate of the previous rotor.

10. A massage water outlet mechanism according to claim 8, wherein the diameter of the arc of the front end face of the close plate of the rotor is equal to that of the back end face.

* * * * *